US012150529B2

(12) United States Patent
Domenico et al.

(10) Patent No.: US 12,150,529 B2
(45) Date of Patent: Nov. 26, 2024

(54) MOBILE SETTING FOR ITEM OF JEWELRY

(71) Applicant: Bulgari Horlogerie SA, Neuchâtel (CH)

(72) Inventors: Rotiroti Domenico, Rome (IT); Fabrizio Buonamassa Stigliani, Hauterive (CH)

(73) Assignee: BULGARI HORLOGERIE SA, Neuchâtel (CH)

( * ) Notice: Subject to any disclaimer, the term of this patent is extended or adjusted under 35 U.S.C. 154(b) by 959 days.

(21) Appl. No.: 16/975,061

(22) PCT Filed: Feb. 18, 2019

(86) PCT No.: PCT/EP2019/053968
§ 371 (c)(1),
(2) Date: Aug. 21, 2020

(87) PCT Pub. No.: WO2019/162232
PCT Pub. Date: Aug. 29, 2019

(65) Prior Publication Data

US 2021/0007448 A1 Jan. 14, 2021

(30) Foreign Application Priority Data

Feb. 22, 2018 (CH) ..... 216/18

(51) Int. Cl.
*A44C 5/02* (2006.01)
*A44C 5/10* (2006.01)

(52) U.S. Cl.
CPC ..... *A44C 5/107* (2013.01)

(58) Field of Classification Search
CPC ..... F16G 15/12; F16G 15/00; F16G 15/04; F16G 15/02; A44C 11/00; A44C 11/007;
(Continued)

(56) References Cited

U.S. PATENT DOCUMENTS 1,589,423 A * 6/1926 Payton ..... A44C 11/007 63/26
1,864,371 A * 6/1932 Prussian ..... A44C 17/0233 63/26

(Continued)

FOREIGN PATENT DOCUMENTS

EP 2896312 A1 7/2015
EP 3087862 A1 11/2016

(Continued)

OTHER PUBLICATIONS

International Search Report dated May 9, 2019, issued in counterpart application No. PCT/EP2019/053968, w/English translation (6 pages).

(Continued)

*Primary Examiner* — Jack W Lavinder
(74) *Attorney, Agent, or Firm* — WHDA, LLP

(57) ABSTRACT

Link for an item of jewelry or watch jewelry, comprising an external link (10) comprising at least one opening (11I) in a visible upper surface, characterized in that it comprises an internal frame (20) comprising a receptacle (21) positioned facing the at least one opening (11) in the external link (10), and at least one decorative element (30) visible on top of the external link (10), comprising for fastening purposes a lower extension (32) passing through the at least one opening (11) in the external link (10) and the receptacle (21) in the internal support (20).

22 Claims, 5 Drawing Sheets

(58) Field of Classification Search
CPC ... A44C 5/02; A44C 17/0208; A44C 17/0216; A44C 17/0225; A44C 17/0233; A44C 5/00; A44C 11/002; A44C 15/005; A44C 15/0055; A44C 17/02; A44C 17/107; A44C 5/102; A44C 5/107; A44C 5/105; A44C 13/00; A44C 17/0275; A44C 17/0258
USPC ..... 59/90
See application file for complete search history.

(56) References Cited

U.S. PATENT DOCUMENTS 2,136,818 A * 11/1938 Kestenman ..... A44C 11/007 63/4
D152,363 S * 1/1949 Philippe ..... D11/16
2,601,094 A * 6/1952 Corbi ..... A44C 5/06 59/79.1
2008/0289363 A1* 11/2008 Langford ..... A44C 9/00 63/1.16
2016/0174670 A1* 6/2016 McAlarney ..... A44C 17/0233 63/15
2016/0316864 A1 11/2016 Cluseau
2017/0231336 A1* 8/2017 Disinger ..... A44C 5/0007 63/1.13

FOREIGN PATENT DOCUMENTS

FR 2058564 A5 5/1971
FR 2621230 A1 * 10/1987

OTHER PUBLICATIONS

Written Opinion dated May 9, 2019, issued in counterpart application No. PCT/EP2019/053968 (5 pages).

* cited by examiner

MOBILE SETTING FOR ITEM OF JEWELRY

The present invention relates to a link for an item of jewelry or watch jewelry. It also relates to an item of jewelry or watch jewelry comprising a plurality of interlinked links.

There exist numerous solutions for fixing decorative stones such as precious stones to an item of jewelry or watch jewelry. There is nevertheless a constant need to offer new solutions for the decoration of such items, including in particular a new way of crimping decorative stones.

The present invention proposes a new solution for the decoration of an item of jewelry or watch jewelry.

To this end, the invention relates to a link for an item of jewelry or watch jewelry, comprising an external link comprising at least one opening in a visible upper surface, characterized in that it comprises an internal frame comprising a housing positioned facing the at least one opening in the external link and at least one decorative element visible on top of the external link, comprising a lower extension passing through the at least one opening in the external link and the housing of the internal frame for fixing it.

The fixing of the at least one decorative element may incorporate play so that the at least one decorative element has an upper part of visible mobility relative to the external link.

The at least one decorative element may be fixed to the internal frame and this internal frame may have a mobility relative to the external link that enables transmission of mobility to the at least one decorative element.

The decorative element may comprise a part of spherical shape intended to remain visible above the external link.

The external link may have a shape enabling it to be nested with another external link of identical shape positioned in an adjacent manner.

The lower extension of the decorative element may be fixed with the aid of a washer positioned under the internal frame.

The external link may have lower extensions for its articulation with another external link of identical shape.

The at least one opening of the external link may have an inclined flank at the level of its upper surface espousing a part of the surface of the decorative element.

The internal frame may have arms extending toward the front and toward the rear to enable interleaving thereof with another internal frame of another link of identical shape.

The external link may have a plurality of openings, the internal frame may have a plurality of housings each disposed facing an opening of the external link, these housings being interconnected by arms of the internal frame, and a decorative element may be fixed at the level of each opening of the external link connected to a housing of the internal frame so that adjacent decorative elements are virtually in contact.

The upper surface of the external link may comprise a shape in a plurality of segments or portions each comprising at least one opening, each segment or portion having a different vertical and/or toward the front or the rear inclination compared to its adjacent segments or portions.

The invention also relates to an item of jewelry or watch jewelry characterized in that it comprises a plurality of links as described above.

The item may comprise two adjacent links the two external links of which are articulated in their lower part and the arms of the two respective internal frames of which are interleaved with each other.

The item may comprise a relative mobility between the various links, the relative movement of two adjacent links inducing the mobility of at least one decorative element of at least one of said two links.

The item may be a bracelet.

The invention also relates to a timepiece characterized in that it comprises a bracelet as described hereinabove.

Other advantages and features will emerge more clearly from the following description of one particular embodiment of the invention given by way of nonlimiting example and represented in the appended drawings, in which.

Figure 1:
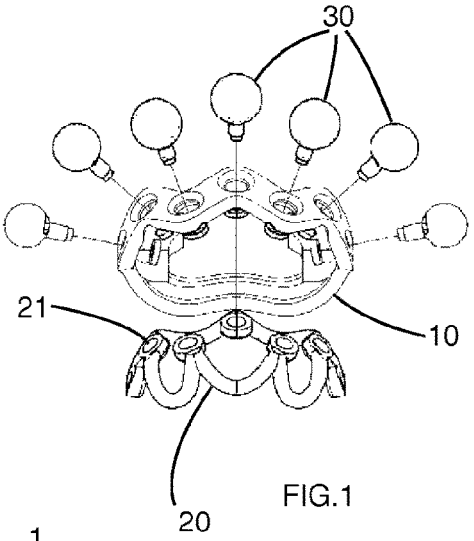
FIG. 1 represents an exploded perspective front view of a link for an item of jewelry according to one embodiment of the invention.
Figure 2:
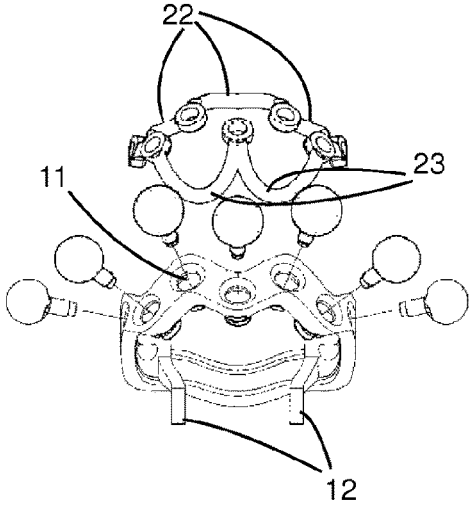
FIG. 2 represents an exploded perspective rear view of the link for an item of jewelry in accordance with one embodiment of the invention.
Figure 3:
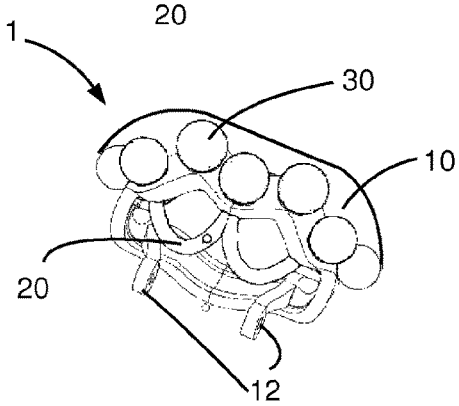
FIG. 3 represents a perspective view from above of a link for an item of jewelry in accordance with one embodiment of the invention.
Figure 4:
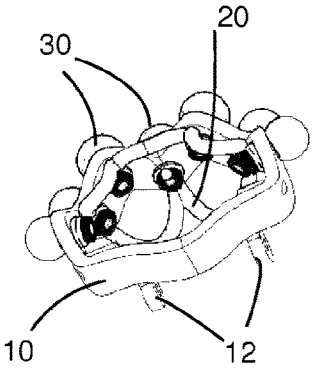
FIG. 4 represents a perspective view from below of the link for an item of jewelry in accordance with one embodiment of the invention.

As is apparent in FIGS. 1 to 4, the items of jewelry according to the embodiment rest on an elementary link 1 that comprises an external link 10, an internal frame 20 and decorative elements 30 fixed to the external link 10 and the internal frame 20.

The external link 10 forms a loop the upper surface of which is equipped with a plurality of openings 11. The visible surface of this external link is referred to as the "upper surface" in a broad sense. It may have any shape as a function of the required esthetic result. Nevertheless, its shape advantageously enables it to be nested with another external link of identical shape to enable the closest possible assembly with an adjacent link, that is to say an adjacent and juxtaposed link. An embodiment of this kind enables the esthetic connection of a multitude of external links 10 of identical shape.

The upper surface of the external link 10 advantageously comprises a plurality of segments each comprising an opening 11, each segment having a different vertical and/or toward the front or of the rear inclination compared to the adjacent segments to enable an overall impression that will be described in detail hereinafter in an assembly of a plurality of links.

The external link 10 further comprises two extensions 12 on the rear face terminating in openings 13 and a lateral opening 14 in the lower part of each side of the external link 10. This construction enables two adjacent links to be disposed so that the extensions 12 of the first come to be positioned at the level of the lateral openings 14 of the second, thus aligning the openings 13, 14 of the two links, which are assembled by a pin 15 in the lower part, enabling their retention articulated about that pin 15. Each external link 10 is advantageously made of a precious metal. Any material is possible, however, depending on the required esthetic aspect.

The internal frame 20 comprises cylindrical portions forming housings 21 intended to be positioned facing the openings 11 of the external link 10, under those openings 11.

It further comprises arms connecting these housings 21, which form front loops 22 extending substantially toward the front and rear loops 23 extending substantially toward the rear. This internal frame 20 may likewise be made of metal such as a precious metal or alternatively any other material. Its function is to ensure cohesion of the future item of jewelry, to guarantee an impression of mobility, as will be described in detail hereinafter. It is intended to remain hardly visible or invisible inside the external links 10.

Finally, the decorative elements 30 take the form of a sphere 31 intended to remain visible above the external link 10, extended by a lower extension 32 intended for a housing in the respective openings 11 of the external link 10 and the housings 21 of the internal frame 20. They may be in one piece or comprise a plurality of parts. The sphere 31 may comprise a precious stone, or a precious metal, etc. The number of openings 11 of the external link 10 is advantageously such that it is possible to accommodate a maximum number of decorative elements the spheres 31 of which come into proximity with one another. Alternatively, the visible upper part of a decorative element could have any shape other than a sphere.

Figure 5:
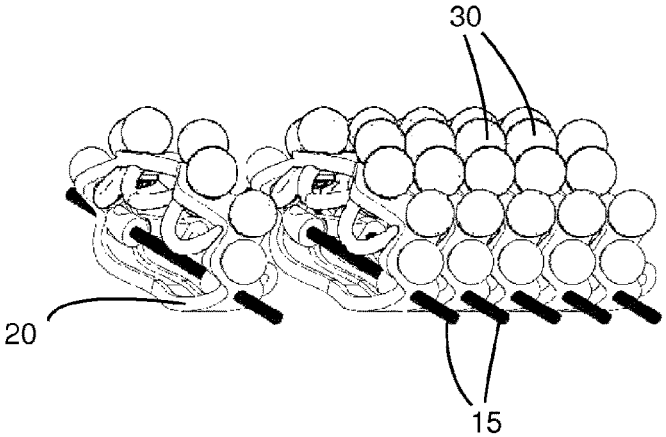
FIG. 5 represents diagrammatically an assembly of links to form an item of jewelry in accordance with the embodiment of the invention.

Assembling these links 1 enables a result represented in FIG. 5 to be achieved, in which figure can be seen a multitude of decorative elements 30 virtually in contact with one another. The upper surface of the external links 10 remains visible between the decorative elements. The position of each decorative element is defined by the openings 11 of each segment of each link: this imparts a non-aligned positioning of the decorative elements 30 on the same link, which creates an attractive visual effect and a better overall impression. On the other hand, as all the links 1 are identical, all of the decorative elements 30 have a regular distribution on the item of jewelry. The links are less identifiable from one another because they are interleaved via their irregular segments, enabling their decorative elements to be positioned in an offset manner on the same link. The width of each link is such that the decorative elements of two adjacent links are positioned in the proximity of each other, possibly almost in contact.

The assembly of the item of jewelry will now be described in detail.

Figure 6:
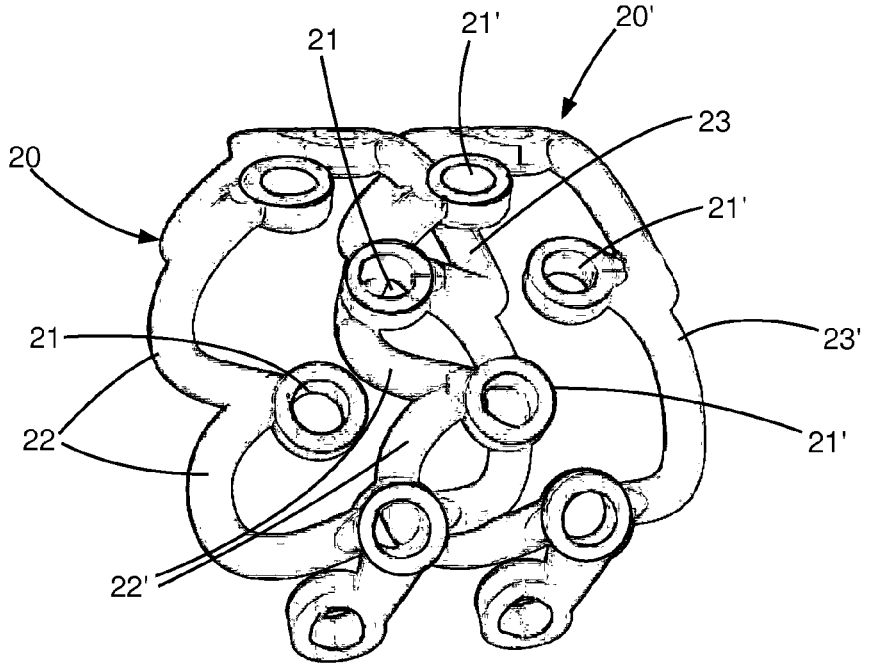
FIGS. 6 to 12 represent diagrammatically steps in assembling the item of jewelry in accordance with the embodiment of the invention.

FIG. 6 shows more particularly the positioning of two adjacent internal frames 20, 20', which are concealed in the finished item. As is apparent in this figure, the rear arms 23 of the first internal frame 20 are interleaved in the front arms 22' of the second internal frame 20'. These two front arms 22' of the second internal frame 20' in particular position two housings 21' substantially above the rear arms 23 of the first internal frame 20. Conversely, the rear arms 23 of the first internal frame 20 position a housing 21 substantially above front arms 22' of the second frame. This results in the following features:

- the two internal frames 20, 20' remain independent of each other, not fixed together;
- nevertheless, their interleaving means that one may form an abutment for the potential movement of the other, or that movement of one may induce movement of the other.

Figure 7:
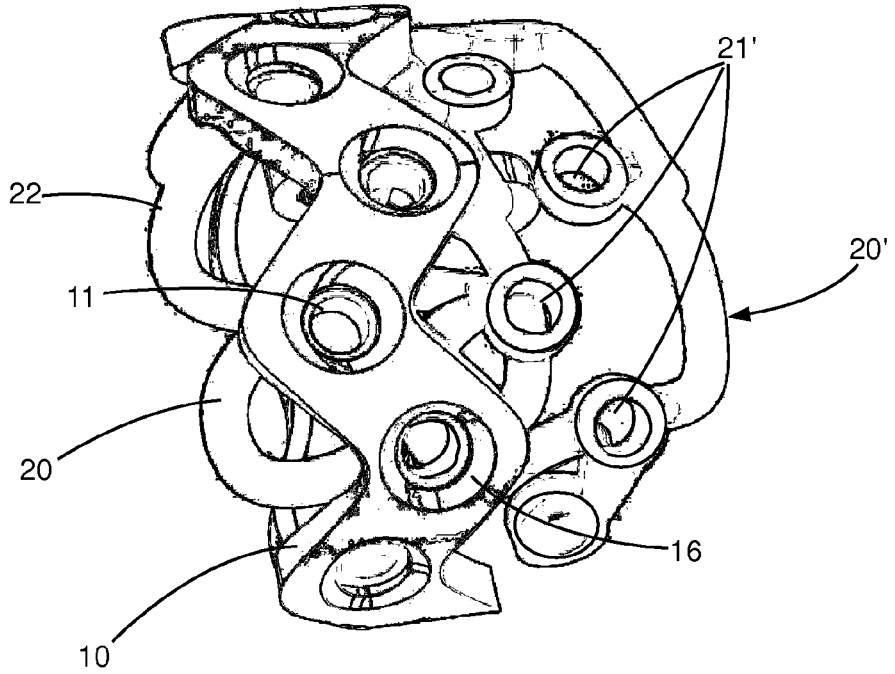

FIG. 7 shows that each internal frame 20 then receives a corresponding external link 10 so that the housings 21 of one internal frame 20 come to be partly accommodated in the openings 11 of the external link 10, via the interior face. Notice in this FIG. 7 that each opening 11 has an inclined flank 16 on its upper surface, ideally with a shape close to part of a sphere corresponding to a sphere 31 of a decorative element 30 to enable its ideal integration bearing on that surface. It is also apparent that the housings 21' of the second frame 20' are positioned to receive a second external link, not represented, of identical shape to the first and coming into contact or virtually into contact with the first.

Figure 8:
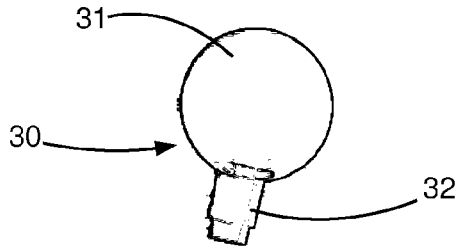
Figure 8:
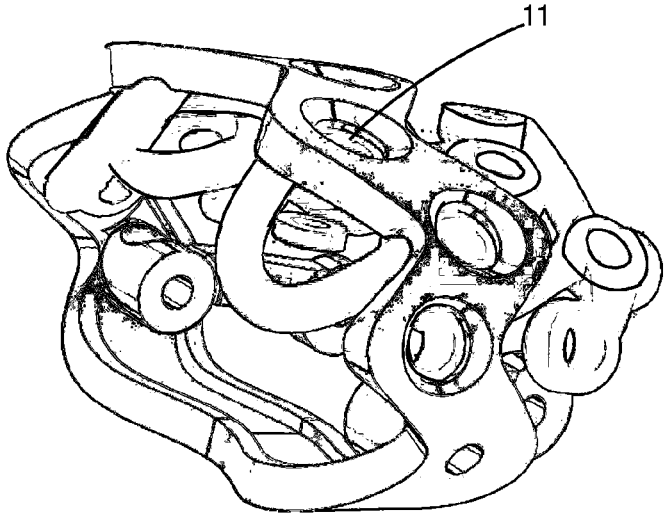
Figure 9:
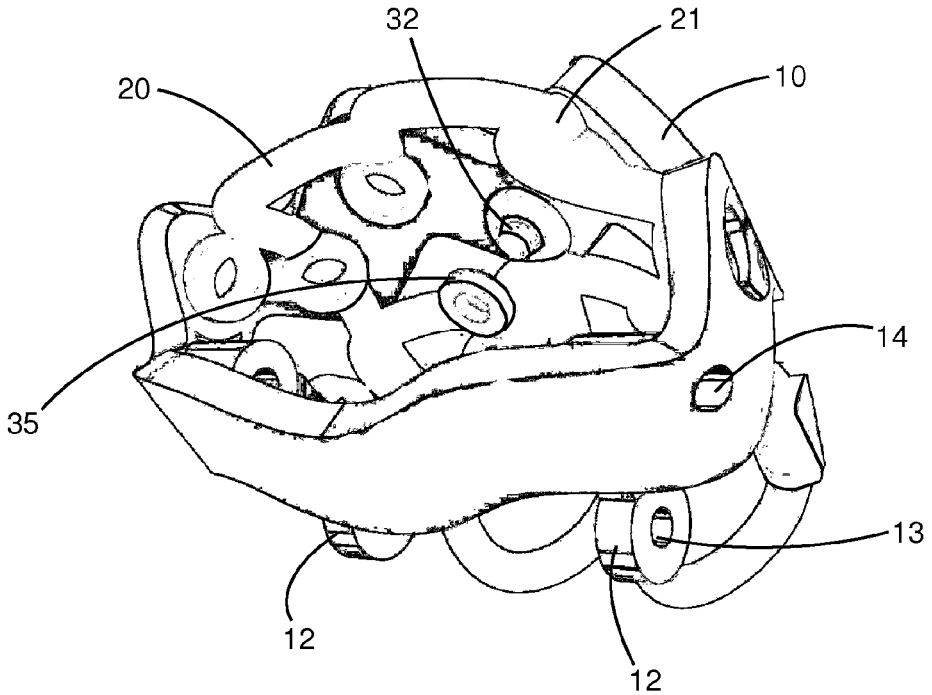
Figure 10:
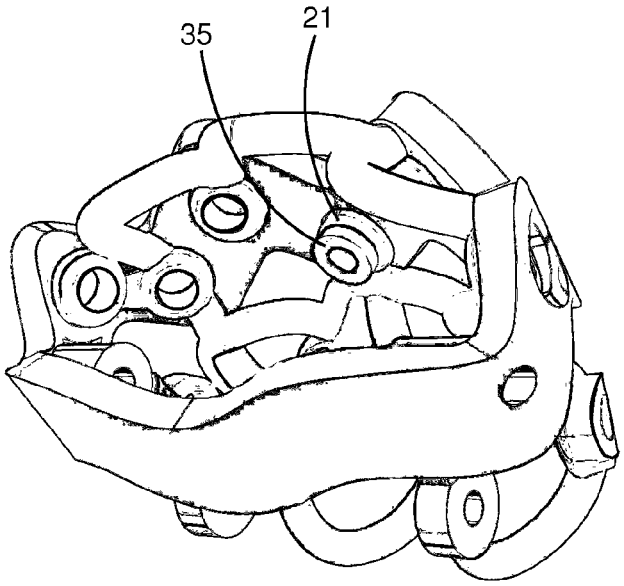

FIGS. 8 to 11 illustrate a step of fixing a decorative element 30. The latter is moved from above toward an opening 11 of an external link 10, as represented in FIG. 8, so that its lower extension 32 comes to penetrate through that opening 11 and through the corresponding housing 21 of the internal frame 20. Its length is such that the end of the lower extension 32 projects under the internal frame 20, as represented in FIG. 9. A locking washer 35 is then moved from below toward this lower extension 32 and fixed to this lower extension by any means, for example by laser welding, to achieve the FIG. 10 result. After this, the decorative element 30 is fixed to the item of jewelry and can no longer be detached.

Figure 11:
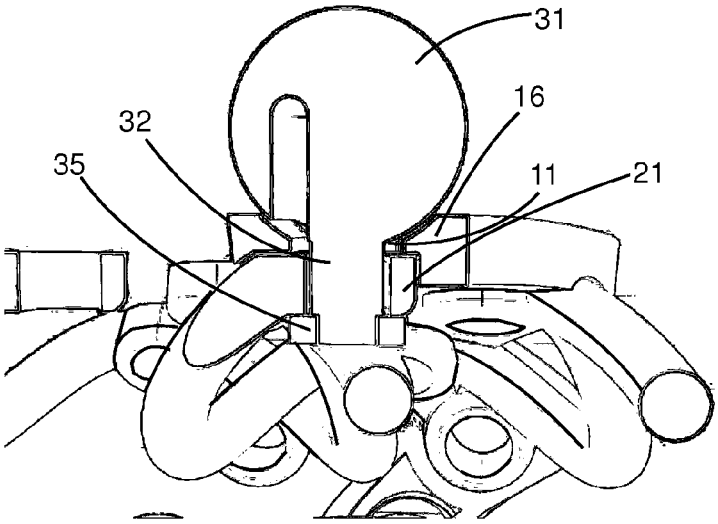

FIG. 11 represents the view in section at the level of this decorative element at the end of mounting. Notice in particular that the cylindrical part forming the housing 21 of the internal frame 20 comes to be inside a corresponding cylindrical part in the lower part of the opening 11 of the external link 10, until they come into abutment. On top, this opening 11 has an inclined flank 16 against which the sphere 31 of the decorative element 30 comes at least partly into contact. Note that this assembly of the three components, the housing 21 of the internal frame 20, the opening 11 of the external link 10 and the lower extension 32 of the decorative element 30, has sufficient play to enable relative movement of these three components, and in particular to produce a visual effect of movement of the sphere 31 of the decorative element relative to the external link 10.

Figure 12:
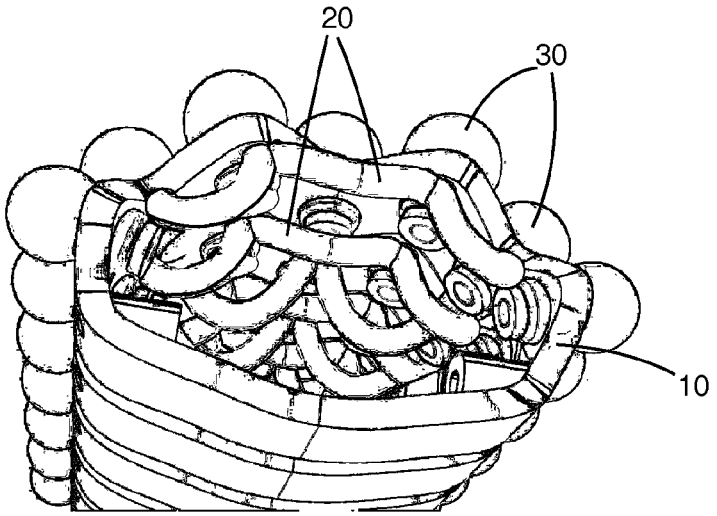

FIG. 12 illustrates a finalized assembly of a plurality of links. An assembly of this kind has the advantage of offering a visual impression of mobility of the item of jewelry. Indeed, each link is articulated to its neighbor, in its lower part, which enables an external link to move away from or toward an adjacent external link. All of the links of the item of jewelry can therefore be more or less curved. In this articulation of the external links to one another, the internal frames 20 brake, accompany, limit the movements in the upper part of the external links, the movement of which is therefore slow and of controlled amplitude. Finally, in these combined movements, stresses therefore arise at the level of the openings 11 of the external link, transmitted by the internal frames 20, the effect of which is a slight movement of the decorative elements that are fixed to these internal frames, because of the aforementioned play. This movement of the decorative elements 30 amplifies the overall impression of mobility.

An assembly of links of this kind enables an item of great length to be formed, for example to form a bracelet. In an item of this kind a visual effect is observed of general undulation of the item, like an undulation of a snake, because of the articulation of all the links, which behave like scales. This undulating movement is amplified by the visible mobility of the decorative elements on the surface of the item during such undulation. From this emerges an impression of great mobility of the item of jewelry.

As mentioned hereinabove, the invention relates to an item that may be a bracelet. It also relates to an item of horology, such as a wristwatch, which may comprise a bracelet of this kind.

The invention is naturally not limited to the embodiment described. In particular, the internal frame could take other shapes. Its connection with the external link could be different, provided that it comprises a part to receive a decorative element facing an opening of the external link. It could moreover be connected to only some of the decorative elements. Some decorative elements could be connected to the external link by any other form of crimping. This external link could likewise have some other shape, for example not completely closed. The decorative elements could have another shape, and not be all identical.

The invention claimed is:

1. A link for an item of jewelry or watch jewelry, comprising an external link comprising at least one opening in a visible upper surface, including an internal frame comprising a housing positioned facing the at least one opening in the external link and at least one decorative element visible on top of the external link, comprising a lower extension passing through the at least one opening in the external link and the housing of the internal frame for fixing it, wherein the external link and the internal frame are separate components, further including that the external link has a shape enabling it to be nested with another external link of identical shape positioned in an adjacent manner.

2. The link as claimed in claim 1, further including that the fixing of the at least one decorative element allows relative movement of the housing of the internal frame, the opening of the external link and the lower extension of the decorative element so that the at least one decorative element has an upper part that is moveable relative to the external link.

3. The link as claimed in claim 2, further including that the at least one decorative element is fixed to the internal frame and the internal frame has a mobility relative to the external link that enables transmission of mobility to the at least one decorative element.

4. The link as claimed in claim 2, further including that the decorative element comprises a part of spherical shape intended to remain visible above the external link.

5. The link as claimed in claim 2, further including that the external link has a shape enabling the external link to be nested with another external link of identical shape positioned in an adjacent manner.

6. The link as claimed in claim 1, further including that the at least one decorative element is fixed to the internal frame and the internal frame has a mobility relative to the external link that enables transmission of mobility to the at least one decorative element.

7. The link as claimed in claim 6, further including that the decorative element comprises a part of spherical shape intended to remain visible above the external link.

8. The link as claimed in claim 1, further including that the decorative element comprises a part of spherical shape intended to remain visible above the external link.

9. The link as claimed in claim 1, further including that the lower extension of the decorative element is fixed with the aid of a washer positioned under the internal frame.

10. The link as claimed in claim 1, further including that the external link has lower extensions for its articulation with another external link of identical shape.

11. The link as claimed in claim 1, further including that the at least one opening of the external link has an inclined flank at an upper surface of the at least one opening, wherein a part of a surface of the decorative element comes into contact with the inclined flank.

12. The link as claimed in claim 1, further including that the internal frame has arms extending toward a front and toward a rear to enable interleaving thereof with another internal frame of another link of identical shape.

13. The link as claimed in claim 1, further including that the external link has a plurality of openings, in that the internal frame has a plurality of housings each disposed facing an opening of the external link, these housings being interconnected by arms of the internal frame, and in that a decorative element is fixed at the level of each opening of the external link connected to a housing of the internal frame.

14. The link as claimed in claim 13, further including that an upper surface of the external link comprises a shape in a plurality of segments or portions each comprising at least one opening, each segment or portion having a different inclination direction compared to adjacent segments or portions.

15. An item of jewelry or watch jewelry, comprising a plurality of links as claimed in claim 1.

16. The item as claimed in claim 15, further including, for two adjacent links, the external links of the two adjacent links are articulated in a lower part and arms of the internal frames of the two adjacent links are interleaved with each other.

17. The item as claimed in claim 15, wherein various links of the plurality of links have relative mobility between the various links, and relative movement of two adjacent links induces mobility of at least one decorative element of at least one of said two adjacent links.

18. The item as claimed in claim 15, wherein the item is a bracelet.

19. A timepiece, comprising a bracelet according to claim 18.

20. A link for an item of jewelry or watch jewelry, comprising an external link comprising at least one opening in a visible upper surface, including an internal frame comprising a housing positioned facing the at least one opening in the external link and at least one decorative element visible on top of the external link, comprising a lower extension passing through the at least one opening in the external link and the housing of the internal frame for fixing it, further including that the at least one decorative element is fixed to the internal frame and the internal frame has a mobility relative to the external link that enables transmission of mobility to the at least one decorative element.

21. A link for an item of jewelry or watch jewelry, comprising an external link comprising at least one opening in a visible upper surface, including an internal frame comprising a housing positioned facing the at least one opening in the external link and at least one decorative element visible on top of the external link, comprising a lower extension passing through the at least one opening in the external link and the housing of the internal frame for fixing it, further including that the external link has lower extensions for its articulation with another external link of identical shape.

22. A link for an item of jewelry or watch jewelry, comprising an external link comprising at least one opening in a visible upper surface, including an internal frame comprising a housing positioned facing the at least one opening in the external link and at least one decorative element visible on top of the external link, comprising a lower extension passing through the at least one opening in the external link and the housing of the internal frame for fixing it, further including that the external link has a plurality of openings, in that the internal frame has a plurality of housings each disposed facing an opening of the external link, these housings being interconnected by arms of the internal frame, and in that a decorative element is fixed at the level of each opening of the external link connected to a housing of the internal frame.

* * * * *